United States Patent [19]

Caesar et al.

[11] 4,111,792

[45] Sep. 5, 1978

[54] COMBINATION PROCESS FOR UPGRADING SYNTHOL NAPHTHA FRACTIONS

[75] Inventors: Philip D. Caesar, Princeton; William E. Garwood, Haddonfield; William F. Krudewig, Riverton, all of N.J.; John J. Wise, Media, Pa.

[73] Assignee: Mobil Oil Corporation, New York, N.Y.

[21] Appl. No.: 767,876

[22] Filed: Feb. 11, 1977

Related U.S. Application Data

[63] Continuation-in-part of Ser. No. 732,235, Oct. 14, 1976.

[51] Int. Cl.[2] ..... C07C 15/02; C10G 37/02

[52] U.S. Cl. ..... 208/79; 208/57; 260/673; 260/673.5

[58] Field of Search ..... 208/79, 80, 57, 62

[56] References Cited

U.S. PATENT DOCUMENTS

| | | | |
|---|---|---|---|
| 3,928,174 | 12/1975 | Bonacci et al. | 208/80 |
| 3,965,205 | 6/1976 | Garwood et al. | 208/120 X |
| 4,041,094 | 8/1977 | Kuo et al. | 208/79 X |
| 4,044,063 | 8/1977 | Ireland et al. | 208/79 X |
| 4,046,829 | 9/1977 | Ireland et al. | 208/88 X |
| 4,046,830 | 9/1977 | Kuo | 208/120 |
| 4,052,477 | 10/1977 | Ireland et al. | 260/676 R |

*Primary Examiner*—Delbert E. Gantz
*Assistant Examiner*—G. E. Schmitkons
*Attorney, Agent, or Firm*—Charles A. Huggett; Carl D. Farnsworth

[57] ABSTRACT

Fischer-Tropsch synthol naptha is upgraded to high octane gasoline with minimum yield loss in a multistep process comprising fractionating the synthol naptha to give a $C_5 + C_6$ fraction and $C_7^+$ fraction, processing the $C_5 + C_6$ fraction over a ZSM-5 catalyst under dense phase conditions, pretreating and reforming the $C_7^+$ fraction under conventional conditions, and blending the $C_5^+$ products from both the $C_5 + C_6$ and $C_7^+$ processing steps.

10 Claims, 3 Drawing Figures

DENSE PHASE PROCESSING OF $C_5+C_6$ FRACTION OVER HZSM-5 CATALYST

LOW PRESSURE REFORMING
PRETREATED SYNTHOL NAPTHA

COMBINATION PROCESS FOR UPGRADING SYNTHOL NAPHTHA FRACTIONS

RELATED APPLICATION

This application is a continuation-in-part of Ser. No. 732,235 filed Oct. 14, 1976.

BACKGROUND OF THE INVENTION

1. Field of the Invention

This invention is concerned with a process for converting synthesis gas, i.e., mixtures of gaseous carbon oxides with hydrogen or hydrogen donors, to hydrocarbon mixtures and oxygenates. More particularly, this invention is concerned with upgrading a $C_5^+$ fraction having an end-point of 340° up to 400° F obtained in a known Fischer-Tropsch synthesis process, so as to obtain a high yield of $C_5^+$ gasoline of enhanced octane and a low-pour, high diesel index fuel oil.

2. Other Prior Art

Processes for the conversion of coal and other hydrocarbons, such as natural gas to a gaseous mixture consisting essentially of hydrogen and carbon monoxide, or of hydrogen and carbon dioxide, or of hydrogen and carbon monoxide and carbon dioxide, are well known. Although various processes may be employed for the gasification, those of major importance depend either on the partial combustion of the fuel with an oxygen-containing gas or on a combination of these two reactions. An excellent summary of the art of gas manufacture, including synthesis gas, from solid and liquid fuels, is given in "Encyclopedia of Chemical Technology", edited by Kirk-Othmer, Second Edition, Volume 10, pages 353–433 (1966), Interscience Publishers, New York; the contents of which are herein incorporated by reference. The techniques for gasification of coal or other solid, liquid or gaseous fuel are not considered to be per se inventive here.

It is considered desirable to effectively and more efficiently convert synthesis gas, and thereby coal and natural gas, to highly valued hydrocarbons such as motor gasoline with high octane number, petrochemical feedstocks, liquefiable petroleum fuel gas, and aromatic hydrocarbons. It is well known that synthesis gas will undergo conversion to form reduction products of carbon monoxides, such as hydrocarbons at from about 300° to about 850° F under from about one to one thousand atmospheres pressure, over a fairly wide variety of catalysts. The Fischer-Tropsch process, for example, which has been most extensively studied, produces a range of products including liquid hydrocarbons, a portion of which have been used as low octane gasoline. The types of catalysts that have been studied for this and related processes include those based on metals or oxides of iron, cobalt, nickel, ruthenium, thorium, rhodium and osmium.

The wide range of catalysts and catalysts modifications disclosed in the art and an equally wide range of conversion conditions for the reduction of carbon monoxide by hydrogen provide considerable flexibility toward obtaining selected boiling-range products. Nonetheless, in spite of this flexibility it has not proven possible to make such selections so as to produce liquid hydrocarbons in the gasoline boiling range having clear research octane numbers above about 70 without further treatment. A review of the status of this art is given in "Carbon Monoxide Hydrogen Reactions", Encyclopedia of Chemical Technology, edited by Kirk-Othmer, Second Edition, Volume 4, pp. 446–488, Interscience Publishers, New York, the text of which is incorporated herein by reference.

Recently, a method for upgrading the $C_5^+$ liquid product of a Fischer-Tropsch synthesis having an end point from about 340°–400° F has been discovered, which method comprises pretreating the $C_5^+$ liquid product by hydrogenating it in the presence of a hydrogenation component (such as platinum or palladium) at conditions of temperature and pressure so as to selectively hydrogenate the diolefins contained in the $C_5^+$ liquid product and thereafter contacting the hydrogenated product, at a temperature within the range of about 575° to 850° F and at a pressure within the range of about atmospheric to 700 psig, with a crystalline aluminosilicate having certain well-defined characteristics. This method is described in a copending United States patent application, Ser. No. 684,511, filed May 7, 1976, now U.S. Pat. No. 4,052,477. It should be noted that the elevated temperatures of the step following pretreatment are such that most or substantially all of the hydrogenated product from the pretreatment step will be in the gaseous phase during the second, aluminosilicate contacting step.

Still more recently, another method for upgrading the $C_{5+}$ liquid product of a Fischer-Tropsch synthesis having an end point from about 340° to 400° F has been discovered, which method comprises contacting the said liquid product in the absence of added hydrogen with a crystalline aluminosilicate, characterized by a pore dimension greater than about 5 Angstroms, a silica to alumina ratio of at least 12, and a constraint index within the range of 1 to 12 at dense phase process conditions of a temperature of about 400° to 700° F, a pressure of about 200 to 1000 psig, and a LHSV of about 0.1 to 2.0 and thereafter recovering a $C_{5+}$ gasoline product boiling up to about 400° F having an enhanced octane value, a 400°–650° F fuel oil product, and a 650° F.$^+$ product. This method is described in copending United States patent application Ser. No. 732,235 filed Oct. 14, 1976. It should be noted that the $C_{5+}$ liquid product is not fractionated prior to the aluminosilicate contacting step.

SUMMARY OF THE INVENTION

This invention is concerned with improving the product distribution and yield of products obtained by a Fischer-Tropsch synthesis gas conversion process. In a particular aspect, the present invention is concerned with upgrading the $C_5$–400° F liquid fraction of a synthesis gas conversion operation known in the industry as the Sasol Synthol process.

The Sasol process, located in South Africa, and built to convert an abundant supply of poor quality coal and products thereof to particularly hydrocarbons, oxygenates and chemical forming components was a pioneering venture. The process complex developed its enormous, expensive to operate and may be conveniently divided or separated into (1) a synthesis gas preparation complex from coal, (2) a Fischer-Tropsch type of synthesis gas conversion in both a fixed catalyst bed operation and a fluid catalyst bed operation, (3) a product recovery operation and (4) auxiliary plant and utility operations required in such a complex.

The extremely diverse nature of the products obtained in the combination operation of the Sasol process amplifies the complexity of the overall process complex, its product recovery arrangement and its operating economics. The Sasol synthesis operation is known to produce a wide spectrum of products including fuel gas, light olefins, LPG, gasoline, light and heavy fuel oils, waxy oils and oxygenates identified as alcohols, acetone, ketones and acids, particularly acetic and propionic acid. The $C_2$ and lower boiling components may be reformed to carbon monoxide and hydrogen or the $C_2$ formed hydrocarbons and methane may be combined and blended for use in a fuel gas pipeline system.

In the Sasol operation, the water soluble chemicals are recovered as by steam stripping distillation and separated into individual components with the formed organic acids remaining in the water phase separately treated. Propylene and butylene formed in the process are converted to gasoline boiling components as by polymerization in the presence of a phosphoric acid catalyst and by alkylation. Propane and butane on the other hand are used for LPG.

The present invention is concerned with improving a Fischer-Tropsch synthesis gas conversion operation and is particularly directed to improving the synthetic gasoline product selectivity and quality obtained by fractionating $C_5$–400° F material to give a $C_5 + C_6$ fraction and a $C_7+$ fraction and thereafter separately processing those fractions. It has been found that improved gasoline yield can be obtained by processing the $C_5 + C_6$ fraction over a ZSM-5 catalyst under dense phase conditions and pretreating and reforming the $C_7^+$ fraction under conventional conditions. The $C_5^+$ products from both processes are blended together, resulting in a gasoline yield which is greater than that obtained by reforming the entire $C_5^+$ naphtha to the same octane number and is also greater than that obtained by reforming the $C_7^+$ more severely to get the same pool octane when blended with the raw untreated $C_5 + C_6$ fraction.

Although combined oxygen in the charge is only partially removed by the present invention, complete oxygen removal is possible by a subsequent hydrotreatment of the gasoline product over a hydrotreating catalyst at 50–300 psig, 500°–600° F, 0.2–10 LHSV, and 200–700 SCF $H_2$/bbl, with little or no octane loss.

The hydrotreating catalyst may be any of those known in the art, such as metals or compounds of subgroups V to VIII of the Periodic Table. A preferred catalyst is one containing a metal oxide or sulfide of Group VI (e.g., Mo) combined with a transition group metal oxide or sulfide (e.g., Co or Ni). Such catalysts may be used in undiluted form but normally are supported on an adsorbent carrier such as alumina, silica, zirconia, titania, and naturally occurring porous supports, e.g., activated high alumina ores such as bauxite or clays such as bentonite, etc. The preferred catalyst is Co/Mo/Alumina.

Finally, it is not necessary to pretreat the $C_5 + C_6$ charge by hydrogenating the diolefins contained therein.

DESCRIPTION OF THE INVENTION

Figure 1:
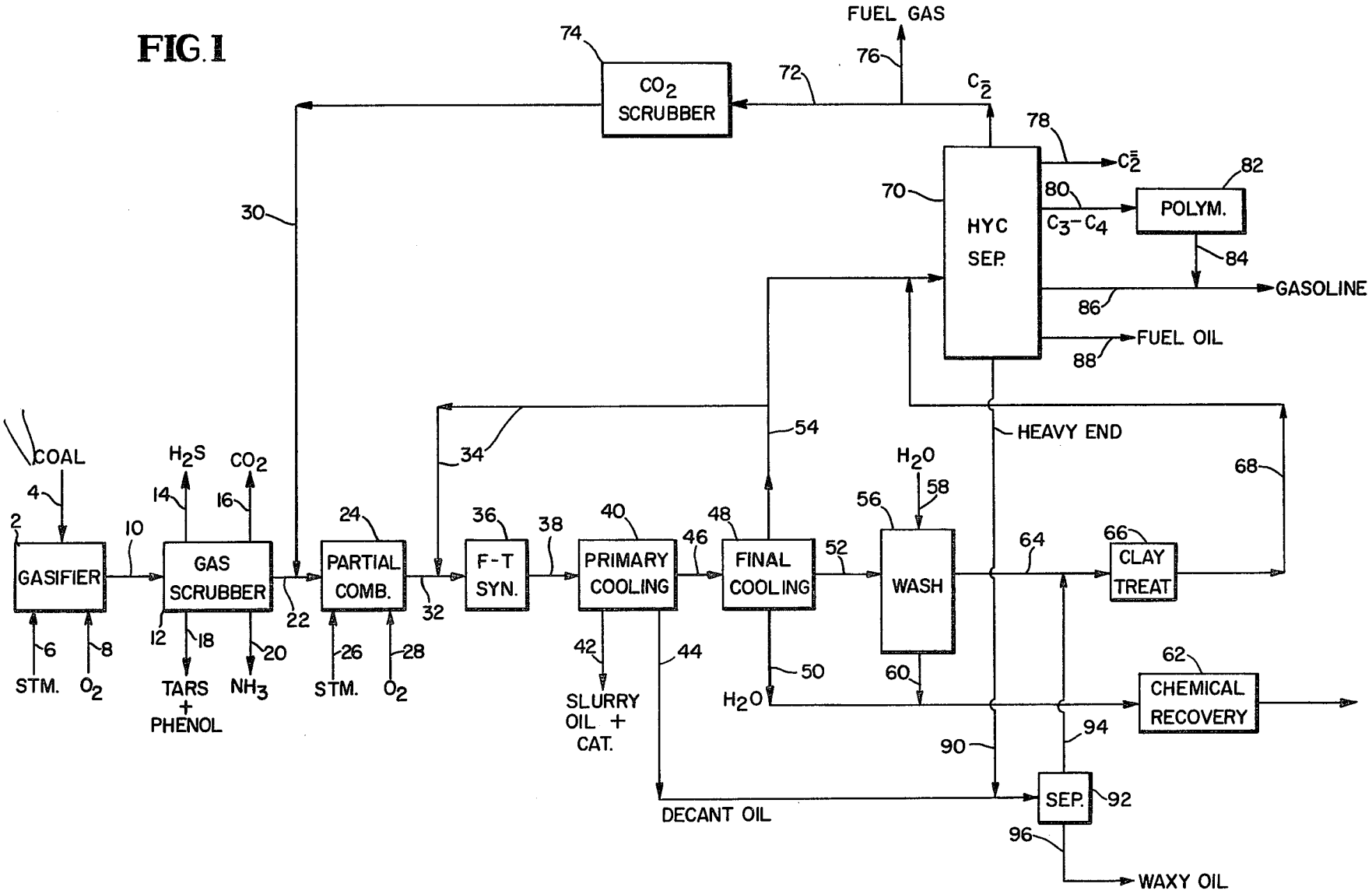
FIG. 1 is a condensed, schematic, block-flow arrangement of a known Fischer-Tropsch syngas conversion process directed to the conversion of coal to synthesis gas comprising carbon monoxide and hydrogen and the reduction of carbon monoxide by the Fischer-Tropsch process to form a product mixture comprising hydrocarbon and oxygenates and the recovery of these products for further use.

Referring now to FIG. 1, there is shown in block-flow arrangement a substantially reduced process flow arrangement of the Sasol syngas conversion process. A coal gasifier section 2 is provided to which pulverized coal is introduced by conduit 4, steam by conduit 6 and oxygen by conduit 8. The products of gasifier section 2 are then passed by conduit 10 to a gas scrubber section 12. In scrubber section 12, carbon monoxide and hydrogen-producing gases are separated from hydrogen sulfide which is removed by conduit 14, carbon dioxide removed by conduit 16, tars and phenols removed by conduit 18 and ammonia removed by conduit 20. The carbon monoxide-hydrogen producing gas is passed from section 12 by conduit 22 to a partial combustion zone 24 supplied with steam by conduit 26 and oxygen by conduit 28. Recycle $C_2$ fuel gas product of the combination process after separation of carbon dioxide therefrom is recycled by conduit 30 to the partial combustion section 24. In the partial combustion operation 24, a suitable carbon monoxide-hydrogen rich synthesis gas of desired ratio is formed for use in a downstream Fischer-Tropsch synthesis gas conversion operation.

The Sasol process operates two versions of the Fischer-Tropsch process; one being a fixed catalyst bed operation and the other being a fluid catalyst bed operation. Each of these operations use iron catalyst prepared and presented to obtain desired catalyst composition and activity. The synthesis gas prepared as above briefly identified is passed by conduit 32 to the Fischer-Tropsch reaction section 36 in admixture with recycle gas introduced by conduit 34 at a temperature of about 160° C and at an elevated pressure of about 365 psig. The temperature of the synthesis gas admixed with catalyst in the fluid operation rapidly rises by the heat liberated so that the Fischer-Tropsch and water gas shift reactions take place. The products of the Fischer-Tropsch synthesis reaction are conveyed by conduit 38 to a primary cooling section 40 wherein the temperature of the mixture is reduced to within the range of 280° to about 400° F. In a primary cooling sectin, a separation is made which permits the recovery of a slurry oil and catalyst stream by conduit 42, and a decant oil stream by conduit 44. In one typical operation, the decant oil stream will have an ASTM 95 percent boiling point of about 900° F. A light oil stream oil stream boiling below about 560° F and lower boiling components including oxygenates is passed by conduit 46 to a second or final cooling and separating section 48. In cooling section 48, a separation is made to recover a water phase comprising water-soluble oxygenates and chemicals withdrawn by conduit 50, a relatively light hydrocarbon phase boiling below about 560° F withdrawn by conduit 52 and a normally vaporous phase withdrawn by conduit 54. A porton of the vaporous phase comprising unreacted carbon monoxide and hydrogen is recycled by conduit 34 to conduit 32 charging syngas to the Fischer-Tropsch synthesis operation. In a typical operation, about one volume of fresh feed is used with two volumes of recycle gas. The hydrocarbons do not completely condense and an absorber system is used for their recovery. Methane and $C_2$ hydrocarbons are blended with other components in a pipeline system or they are passed to a gas reforming section for recycle as feed gas in the synthesis operation. The light hydrocarbon phase in conduit 52 is then passed through a water wash section 56 provided with wash water by conduit 58. In wash section 56, water-soluble materials comprising oxygenates are removed and withdrawn therefrom by conduit 60. The water phases in conduits 50 and 60 are combined and passed to a complicated and expensive-to-run chemicals recovery operation 62. The washed light hydrocarbon phase is removed by conduit 64 and passed to a clay treater 66 along with hydrocarbon fraction boiling below about 650° F recovered from the decanted oil phase in conduit 44 and a heavy oil product fraction recovered as hereinafter described. The hydrocarbon phase thus recovered and passed to this caly treating section is preheated to an elevated temperature of above about 600° F or higher before contacting the catalyst or clay in the treater. This clay treatment isomerizes hydrocarbons and particularly the alpha olefins in the product, thereby imparting a higher octane rating to these materials. The treatment also operates to convert harmful acids and other oxygenates retained in the hydrocarbon phase after the water wash. The clay treated hydrocarbon product is passed by conduit 68 to a hydrocarbon separation reaction 70. A portion of the hydrocarbon vapors in conduit 54 not directly recycled to the Fischer-Tropsch conversion operation by conduit 34 is also passed to the hydrocarbon separation reaction 70. In the hydrocarbon separation section 70, a separation is made to recover a fuel gas stream comprising $C_2$ hydrocarbons withdrawn by conduit 72. A portion of this material is passed through a $CO_2$ scrubber 74 before recycle by conduit 30 to the partial combustion zone 24. A portion of the fuel gas may be withdrawn by conduit 76. In separation section 70, a $C_2$ olefin-rich stream is recovered by conduit 78 for chemical processing as desired. A $C_3$ to $C_4$ hydrocarbon stream rich in olefins is withdrawn by conduit 80 and passed to catalytic polymerization in section 82. Polymerized material suitable for blending with gasoline product is withdrawn by conduit 84. A $C_5^+$ gasoline product fraction having an end point in the range of 340° to 360° up to 400° F is recovered by conduit 86 and a light fuel oil product such as No. 2 fuel oil is withdrawn by conduit 90 for admixture with the decant oil fraction in conduit 44 as mentioned above. The blend of hydrocarbons product thus formed will boil in the range of about 400° to about 1000° F. This material blend is passed to a separator section 92 wherein a separation is made to recover a fraction boiling in the range of from about 400° to 650° F withdrawn by conduit 44 from a heavier higher boiling waxy oil withdrawn by conduit 96.

In this relatively complicated synthesis gas conversion operation and product recovery, it is not unusual to recover a product distribution comprising 2 percent ethylene, 8 percent LPG, 70 percent gasoline boiling material, 3 percent fuel oil, 3 percent waxy oil and about 14 percent of materials defined as oxygenates.

This Fischer-Tropsch synthesis operation above briefly defined and known in the industry as the Sasol Synthol process can be significantly improved following the concepts of this invention. It is the purpose of the invention to substantially upgrade the $C_5-$ 340° to 400° F gasoline fraction (i.e., the product from conduit 86 prior to blending via conduit 84) by first fractionating the $C_5-$ 340° to 400° F gasoline product from conduit 86 to separate a $C_5 + C_6$ fraction and a $C_7^+$ fraction and then separately processing these separated fractions.

The $C_7^+$ fraction is processed according to known reforming methods at conditions including temperatures of about 700° to about 1000° F, pressures ranging between about 100 to 1000 psig (preferably 200 to 500 psig), LHSV of about 0.1 to 10 (preferably 1 to 4), and a molar ratio of hydrogen to hydrocarbon charge of about 1 to 20 (preferably 2.5 to 10). Individual reformer unit designs may include multiple reactors, custom catalyst distribution, interheaters, recycle hydrogen gas distribution, and moisture control equipment. A typical reformer will also include a pretreat or catalytic desulfurization section for removal of harmful metallic, nitrogen, and arsenic compounds, desulfurization, and saturation of olefinic compounds in the presence of hydrogen.

The catalyst employed in the reforming operation is required to have a duality of functions: it must possess an acid function to promote isomerization and an electron defect structure to promote dehydrogenation. Among the more preferred catalysts are platinum-containing reforming catalysts such as Sinclair-Baker RD-150 and 150-C catalysts, and the E-600 series of bimetallic catalysts, and other known bimetallic or multimetallic reforming catalysts.

Catalytic pretreatment of the reformer feedstock is required when platinum is employed as the reformer catalyst. Sulfur, nitrogen, oxygen, halides and trace metals are removed by hydrogen treating and olefins in cracked stocks are hydrogenated. Usually, the mild hydrogenation takes place over a cobalt-molybdenum catalyst. The hydrogen required is available, of course, from the reforming operation. Operating pressures are usually 200 to 500 psi; temperatures are between 400° and 750° F; and liquid yields are usually 100 volume percent or slightly higher.

The separated $C_5 + C_6$ fraction is treated by "dense phase" processing over a special type of crystalline aluminosilicate zeolite catalyst.

The special zeolite catalysts referred to herein utilize members of a special class of zeolite exhibiting some unusual properties. These zeolites induce profound transformations of aliphatic hydrocarbons to aromatic hydrocarbons in commercially desirable yields and are generally highly effective in alkylation, isomerization, disproportionation and other reactions involving aromatic hydrocarbons. Although they have unusually low alumina contents, i.e., high silica to alumina ratios, they are very active even with silica to alumina ratios exceeding 30. This activity is surprising since catalytic activity of zeolites is generally attributed to framework aluminum atoms and cations associated with these aluminum atoms. These zeolites retain their crystallinity for long periods in spite of the presence of steam even at high temperatures which induce irreversible collapse of the crystal framework of other zeolites, e.g., of the X and A type. Furthermore, carbonaceous deposits, when formed, may be removed by burning at higher than usual temperatures to restore activity. In many environments, the zeolites of this class exhibit very low coke-forming capability conducive to very long times on stream between burning regenerations.

An important characteristic of the crystal structure of this class of zeolites is that it provides constrained access to and egress from the intra-crystalline free space by virtue of having a pore dimension greater than about 5 Angstroms and pore windows of about a size such as would be provided by 10-membered rings of oxygen atoms. It is to be understood, of course, that these rings are those formed by the regular disposition of the tetrahedra making up the anionic framework of the crystalline aluminosilicate, the oxygen atoms themselves being bonded to the silicon or aluminum atoms at the centers of the tetrahedra. Briefly, the preferred zeolites useful as catalysts in this invention process, in combination: a silica to alumina ratio of at least about 12; and a structure providing constrained access to the crystalline-free space.

The silica to alumina ratio referred to may be determined by conventional analysis. This ratio is meant to represent as closely as possible, the ratio in the rigid anionic framework of the zeolite crystal and to exclude aluminum in the binder or in cationic or other form within the channels. Although zeolites with a silica to alumina ratio of at least 12 are useful, it is preferred to use zeolites having higher ratios of at least about 30. Such zeolites, after activation, acquire an intra-crystalline sorption capacity for normal hexane which is greater than that for water, i.e., they exhibit "hydrophobic" properties. It is believed that this hydrophobic character is advantageous in the present invention.

The zeolites useful as catalysts in this invention freely sorb normal hexane and have a pore dimension greater than about 5 Angstroms. In addition, their structure must provide constrained access to some larger molecules. It is sometimes possible to judge from a known crystal structure whether such constrained access exists. For example, if the only pore windows in a crystal are formed by 8-membered rings of oxygen atoms, then access by molecules of larger cross-section than normal hexane is substantially excluded and the zeolite is not of the desired type. Zeolites with windows of 10-membered rings are preferred, although excessive puckering or pore blockage may render these zeolites substantially ineffective. Zeolites with windows of 12-membered rings do not generally appear to offer sufficient constraint to produce the advantageous conversions desired in the instant invention, although structures can be conceived, due to pore blockage or other cause, that may be operative.

Rather than attempt to judge from crystal structure whether or not a zeolite possesses the necessary constrained access, a simple determination of the "constraint index" may be made by continuously passing a mixture of equal weight of normal hexane and 3-methylpentane over a small sample, approximately 1 gram or less, of zeolite at atmospheric pressure according to the following procedure. A sample of the zeolite, in the form of pellets or extrudate, is crushed to a particle size about that of coarse sand and mounted in a glass tube. Prior to testing, the zeolite is treated with stream of air at 1000° F for at least 15 minutes. The zeolite is then flushed with helium and the temperature adjusted between 550° and 950° F to give an overall conversion between 10 percent and 60 percent. The mixture of hydrocarbons is passed at 1 liquid hourly space velocity (i.e., 1 volume of liquid hydrocarbon per volume of catalyst per hour) over the zeolite with a helium dilution to give a helium to total hydrocarbon mole ratio of 4:1. After 20 minutes on stream, a sample of the effluent is taken and analyzed, most conveniently by gas chromotography, to determine the fraction remaining unchanged for each of the two hydrocarbons.

The constraint index is calculated as follows:

$$\text{Constraint Index} = \frac{\log_{10}(\text{fraction of n-hexane remaining})}{\log_{10}(\text{fraction of 3-methylpentane remaining})}$$

The constraint index approximates the ratio of the cracking rate constants for the two hydrocarbons. Catalysts suitable for the present invention are those which employ a zeolite having a constraint index from 1.0 to 12.0. Constraint Index (CI) values for some typical zeolites, including some not within the scope of this invention are:

| CAS | C.I. |
|---|---|
| ZSM-5 | 8.3 |
| ZSM-11 | 8.7 |
| ZSM-35 | 4.5 |
| TMA Offretite | 3.7 |
| ZSM-12 | 2 |
| ZSM-38 | 2 |
| Beta | 0.6 |
| ZSM-4 | 0.5 |
| Acid Mordenite | 0.5 |
| REY | 0.4 |
| Amorphous Silica-alumina | 0.6 |
| Erionite | 38 |

The above-described Constraint Index is an important and even critical definition of those zeolites which are useful to catalyze the instant process. The very nature of this parameter and the recited technique by which it is determined, however, admit of the possibility that a given zeolite can be tested under somewhat different conditions and thereby have different constraint indexes. Constraint Index seems to vary somewhat with severity of operation (conversion). Therefore, it will be appreciated that it may be possible to so select test conditions to establish multiple constraint indexes for a particular given zeolite which may be both inside and outside the above-defined range of 1 to 12.

Thus, it should be understood that the "Constraint Index" value as used herein as an inclusive rather than an exclusive value. That is, a zeolite when tested by any combination of conditions within the testing definition set forth hereinabove to have a constraint index of 1 to 12 is intended to be included in the instant catalyst definition regardless that the same identical zeolite tested under other defined conditions may give a constraint index value outside of 1 to 12.

The class of zeolites defined herein is exemplified by ZSM-5, ZSM-11, ZSM-12, ZSM-21, ZSM-35, ZSM-38 and other similar material. Recently issued U.S. Pat. No. 3,702,886 describing and claiming ZSM-5 is incorporated herein by reference.

ZSM-11 is more particularly described in U.S. Pat. No. 3,709,979, the entire contents of which are incorporated herein by reference.

ZSM-12 is more particularly described in U.S. Pat. No. 3,832,449, the entire contents of which are incorporated herein by reference.

U.S. patent application Ser. No. 358,192, filed May 7, 1973, the entire contents of which are incorporated herein by reference, describes a zeolite composition and a method of making such, designated as ZSM-21 which is useful in this invention.

U.S. patent application Ser. No. 528,061, filed Nov. 29, 1974, (now U.S. Pat. No. 4,016,265) the entire contents of which are incorporated herein by reference, describes a zeolite composition including a method of making it. This composition is designated ZSM-35 and is useful in this invention.

U.S. patent application Ser. No. 528,060, filed Nov. 29, 1974, (now abandoned) and Ser. No. 560,412 (now U.S. Pat. No. 4,046,859), the entire contents of which are incorporated herein by reference, describe a zeolite composition including a method of making it. This composition is designated ZSM-38 and is useful in this invention.

The X-ray diffraction pattern of ZSM-21 appears to be generic to that of ZSM-35 and ZSM-38. Either or all of these zeolites is considered to be within the scope of this invention.

The specific zeolites described, when prepared in the presence of organic cations, are substantially ctalytically inactive, possibly because the intracrystalline free space is occupied by organic cations from the forming solution. They may be activated by heating in an inert atmosphere at 1000° F for one hour, for example, followed by base exchange with ammonium salts followed by calcination at 1000° F in air. The presence of organic cations in the forming solution may not be absolutely essential to the formation of this special type zeolite; however, the presence of these cations does appear to favor the formation of this special type of zeolite. More generally, it is desirable to activate this type zeolite by base exchange with ammonium salts followed by calcination in air at about 1000° F for from about 15 minutes to about 24 hours.

Natural zeolites may sometimes be converted to this type zeolite by various activation procedures and other treatments succh as base exchange, steaming, alumina extraction and calcination alone or in combinations. Natural minerals which may be so treated include ferrierite, brewsterite, stilbite, dachiardite, epistilbite, heulandite and clinoptilolite. The preferred crystalline aluminosilicates are ZSM-5, ZSM-11, ZSM-12 and ZSM-21, with ZSM-5 particularly preferred.

The zeolites used as catalysts in this invention should be essentially in the hydrogen form. They may be base exchanged or impregnated to contain a Group VIII metal for enhanced stability. It is desirable to calcine the zeolite after base exchange. The metal cations that may be present include any of the cations of the metals of Group VIII of the periodic table.

In a preferred aspect of this invention, the zeolites useful as catalysts herein are selected as those having a crystal framework density, in the dry hydrogen form, of not substantially below about 1.6 grams per cubic centimeter. It has been found that zeolites which satisfy all three of these criteria are most desired. Therefore, the preferred catalysts of this invention are those comprising zeolites having a constraint index as defined above of about 1 to 12, a silica to alumina ratio of at least about 12 and a dried crystal density of not substantially less than about 1.6 grams per cubic centimeter. The dry density for known structures may be calculated from the number of silicon plus aluminum atoms per 1000 cubic Angstroms, as given, e.g., on page 19 of the article on Zeolite Structure by W. M. Meier. This paper, the entire contents of which are incorporated herein by reference, is included in "Proceedings of the Conference on Molecular Sieves, London, April 1967" published by the Society of Chemical Industry, London, 1968. When the crystal structure is unknown, the crystal framework density may be determined by classical pyknometer techniques. For example, it may be determined by immersing the dry hydrogen form of the zeolite in an organic solvent which is not sorbed by the crystal. It is possible that the unusual sustained activity and stability of this class of zeolites is associated with its high crystal anionic framework density of not less than about 1.6 grams per cubic centimeter. This high density, of course, must be associated with a relatively small amount of free space within the crystal, which might be expected to result in more stable structures. This free space, however, seems to be important as the locus of catalytic activity.

Crystal framework densities of some typical zeolites including some which are not within the purview of this invention are:

| Zeolite | Void Volume | Framework Density |
|---|---|---|
| Ferrierite | 0.28 cc/cc | 1.76 g/cc |
| Mordenite | .28 | 1.7 |
| ZSM-5, -11 | .29 | 1.79 |
| Dachiardite | .32 | 1.72 |
| L | .32 | 1.61 |
| Clinoptilolite | .34 | 1.71 |
| Laumontite | .34 | 1.77 |
| ZSM-4 (Omega) | .38 | 1.65 |
| Heulandite | .39 | 1.69 |
| P | .41 | 1.57 |
| Offretite | .40 | 1.55 |
| Levynite | .40 | 1.54 |
| Erionite | .35 | 1.51 |
| Gmelinite | .44 | 1.46 |
| Chabazite | .47 | 1.45 |
| A | .5 | 1.3 |
| Y | .48 | 1.27 |

As has heretofore been stated, the most preferred form of the specific, previously defined zeolites in carrying out the novel process of this invention is the hydrogen form. As acid form is well known in the art, the hydrogen form can be made by base exchanging the particular zeolite with hydrogen ions or ions capable of conversion to hydrogen ions, i.e., ammonium ions.

The crystalline zeolite compositions can also be admixed with a non-acidic inorganic binder, such as alumina in order to impart the desired properties to the zeolite, such as increased strength and attrition resistance. Quite obviously, the proportion of binder employed is not narrowly critical, and it has been found convenient to use compositions where the binder is present from about 10 to 70 percent and preferably 30–40 percent based on the total weight of the zeolite plus binder.

By the term "dense phase" processing, as used herein, is meant the maintenance of most of the charge and product in contact with the catalyst of this invention in the liquid phase. The quantity of charge and product present in the liquid phase is preferably greater than 90 percent of the total quantity of charge and product in contact with the catalyst. The operating conditions of the dense phase technique are pressures of 200 to 1000 psig, no hydrogen, temperatures of the order of 300° to 700° F and LHSV of 0.1 to 5. As was mentioned previously, the primary purpose of the technique is to minimize catalyst aging by allowing the liquid phase charge and product "to wash off" coke precursors from the catalyst surface. Preferred operating conditions are pressures of 600 to 700 psig, no hydrogen, temperatures of 325° to 500° F and LHSV of 0.1 to 2.0.

Since a pure gas at temperatures above its critical temperature canot be liquefied, regardless the degree of compression, it is essential that the temperature of process of this invention will be well below the critical point of the mix present in the catalyst contacting zone. The critical point of the mix represents the condition at which the specific properties of the liquid and gas phases become identical, causing the phases to be indistinguishable. To indicate the range of the critical properties of the substances contained in $C_5^-$ 400° F charge and the products of the process of this invention, the following properties of various hydrocarbons have been selected from F. p. Rossini et al, "Selected Values of Physical and Thermodynamic Properties of Hydrocarbons and Related Compounds", Carnegie Press. Pittsburgh, Pa., 1953:

| | | |
|---|---|---|
| Pentene-1 | 394° F | 586 psi |
| n-Pentane | 386° F | 490 psi |
| n-Hexane | 455° F | 440 psi |
| n-Heptane | 512° F | 397 psi |
| n-Octane | 565° F | 362 psi |
| n-Nonane | 611° F | 331 psi |
| n-Decane | 654° F | 306 psi |

Critical properties for olefins greater than $C_5$ were not included by Rossini but may be estimated by methods such as the one described by Gambill in *Chemical Engineering,* June 15, 1959, pp. 182–83; and *Chemical Engineering,* July 13, 1959, pp. 157–160; or by Nokay in *Chemical Engineering, Feb.* 23, 1959, p. 146.

After pretreatment/reforming of the separated $C_7^+$ fraction by conventional methods and dense phase processing of the separated $C_5 + C_6$ fraction, the $C_5^+$ products from both processes are blended together, yielding relatively high quantities of high-octane gasoline.

The following examples further illustrate and describe the method of this invention.

EXAMPLE 1

A $C_5-$ 400° F liquid fraction product of Fischer-Tropsch synthesis was distilled to separate a $C_5 + C_6$ fraction. The separated $C_5 + C_6$ fraction was passed over HZSM-5 extrudate at 700 psig, 1 LHSV, and temperatures of 300° to 600° F. Properties of the $C_5 + C_6$ charge are shown in Table I. The HZSM-5 extrudate contained 35 percent alumina binder, was sized to 30–60 mesh, and was charged to a 9/32 inch i.d. s.s. tubing reactor where it was pretreated with hydrogen at 900° F for one hour. After catalyst pretreatment, the reactor was pressured to 700 psig with nitrogen against a grove loader, and then the $C_5 + C_6$ charge was pumped downflow over the catalyst bed at reaction temperature. Yields and properties of products are listed in Table I and are platted against temperature in FIG. 2.

Figure 2:
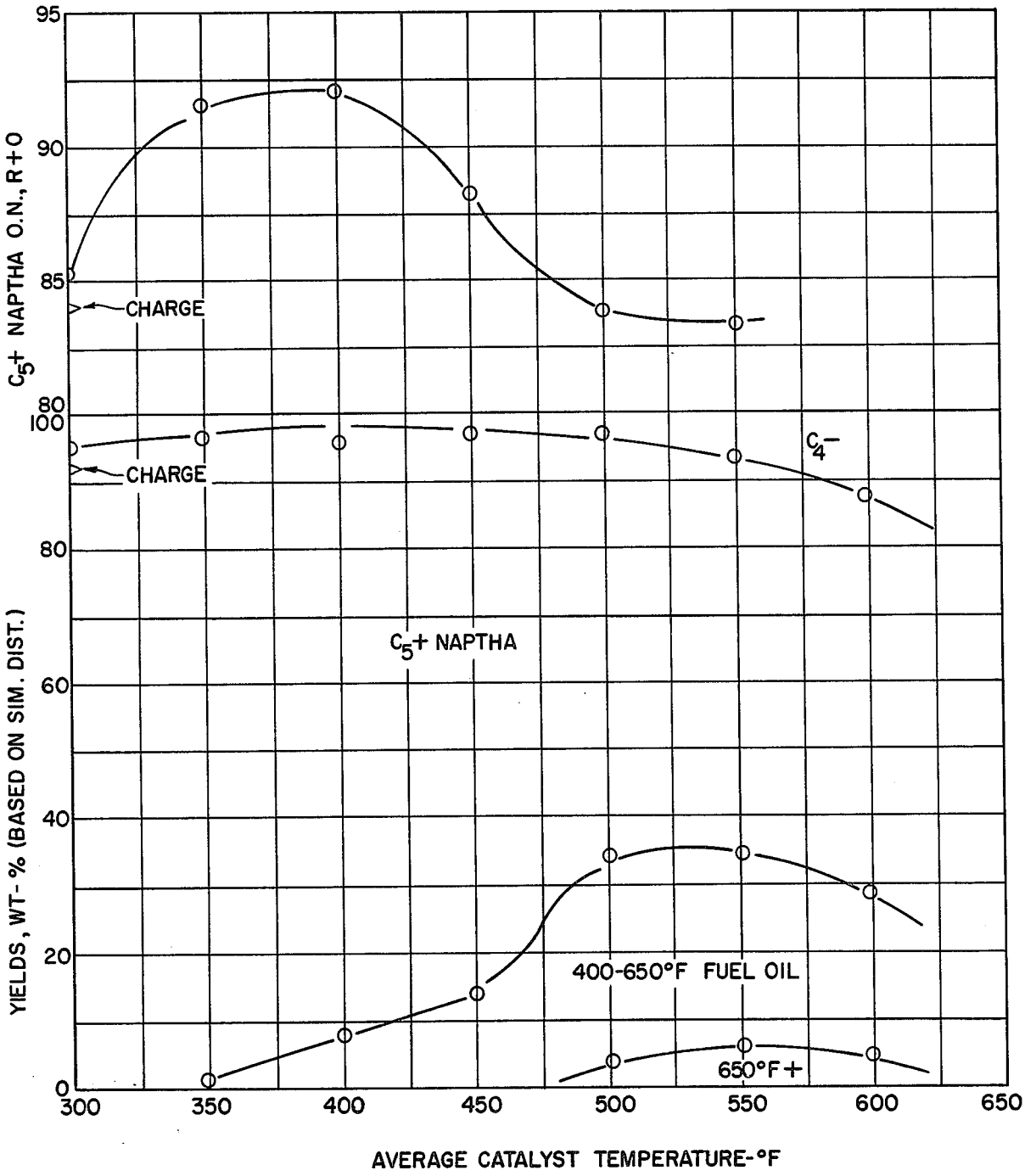
FIG. 2 is a plot of product yields and $C_5^+$ naphtha R.O.N. (R + O) versus dense phase processing temperature derived from an example of treating the $C_5 + C_6$ fraction of $C_5^+$ liquid product from a Fischer-Tropsch synthesis according to the method of this invention.

Referring now to FIG. 2, it will be noted that the amount of $C_4^-$ does not increase until temperatures above 550° F are used. Fuel oil (400° $F^+$) starts to appear at about experimental temperatures of 400° F, reaches a maximum of 35 percent at temperatures of 500°–550° F, and then declines as cracking begins. Some of the polymer formed boils above 650° F. The data in Table I show a small disappearance of $C_5$ and $C_6$ olefins up to 400° F, with a rapid disappearance above that temperature.

The plot of $C_5^+$ naptha octane number (R + O) versus temperature in FIG. 2 shows an increase in octane at 350° to 400° F and a decrease thereafter. The increase is due to isomerization of the 1-olefin to internal olefin. The octane decrease at 450° F and above to values about that of the charge is due to loss of $C_5$ and $C_6$ olefins via polymerization and enrichment of low octane paraffins and formation of higher molecular weight olefins. No aromatics are made. The highest octane (92.0 R + O) was obtained at 400° F with complete liquid recovery and a satisfactory 90 percent boiling point of 380° F.

The materials produced at 350° and 400° F are, except for the last few percent at 400° F, within the gasoline boiling range (See data for run numbers 3 and 4 in Table I).

Table I

| Run Number | | 1 | 2 | 3 | 4 | 5 | 6 | 7 | 8 |
|---|---|---|---|---|---|---|---|---|---|
| Run Time, Hrs. | | 24 | 22½ | 17 | 5 | 16 | 5 | 6½ | 5½ |
| Days on Stream | | 1.0 | 2.0 | 2.8 | 3.0 | 3.7 | 4.0 | 4.3 | 4.5 |
| LHSV | Charge | 1.3 | 1.0 | 1.0 | 1.0 | 1.0 | 1.0 | 1.0 | 1.0 |
| Temp., ° F, Average | | 452 | 501 | 401 | 350 | 551 | 450 | 600 | 301 |
| Maximum | | 455 | 507 | 402 | 352 | 558 | 452 | 604 | 305 |
| Liquid Product | | | | | | | | | |
| Gravity, ° API | 79.8 | 61.2 | 55.6 | 70.2 | 75.7 | 57.0 | 57.4 | 55.6 (1) | 76.5 |
| Gravity, Specific | .6697 | .7343 | .7563 | .7015 | .6829 | .7507 | .7491 | .7563 | .6803 |
| Sim. Dist. 50% B.P., ° F | 142 | 307 | 356 | 163 | 158 | 323 | 337 | 270 | 147 |
| 90% | 180 | 419 | 559 | 380 | 208 | 583 | 552 | 550 | 186 |
| Yields, Wt. % | | | | | | | | | |
| $C_1$–$C_3$ | 0.1 | 0.2 | 0.1 | 0.1 | — | 0.5 | 0.4 | 2.7 | 0.9 |
| $C_4$'s Total | 6.1 | 2.9 | 2.8 | 4.5 | 3.8 | 5.9 | 4.4 | 9.4 | 4.9 |
| i-$C_4$ | — | 0.1 | 0.5 | 0.1 | — | 2.1 | 1.6 | 4.9 | 0.2 |
| $C_4$= | 5.2 | 1.5 | 0.6 | 3.6 | 3.2 | 1.7 | 1.2 | 0.8 | 3.9 |
| n-$C_4$ | 0.9 | 1.3 | 1.7 | 0.8 | 0.6 | 2.1 | 1.6 | 3.7 | 0.8 |
| $C_5$'s Total | 34.5 | 19.6 | 14.2 | 29.6 | 30.5 | 23.7 | 20.3 | 20.7 | 30.6 |
| i-$C_5$ | 0.9 | 2.0 | 3.2 | 1.3 | 0.9 | 5.8 | 4.0 | 0.2 | 1.1 |
| $C_5$= | 29.9 | 11.0 | 3.2 | 23.8 | 25.9 | 9.7 | 9.0 | 5.6 | 25.9 |
| n-$C_5$ | 3.7 | 6.6 | 8.0 | 4.5 | 3.7 | 8.2 | 7.3 | 6.9 | 3.6 |
| $C_6$'s Total | 53.8 | 24.7 | 12.0 | 47.4 | 56.3 | 15.9 | (2) | (3) | 57.6 |
| i-$C_6$ | 1.9 | 3.9 | 3.9 | 3.0 | 3.1 | 6.2 | | | 2.0 |
| $C_6$= | 46.5 | 14.9 | 1.9 | 38.1 | 45.8 | 3.0 | | | 46.2 |
| n-$C_6$ | 4.8 | 5.5 | 5.5 | 5.6 | 6.1 | 6.2 | | | 8.6 |
| Cycloparaffin | 0.2 | 0.2 | 0.4 | 0.5 | 1.0 | 0.8 | | | 0.4 |
| Benzene | 0.4 | 0.2 | 0.3 | 0.2 | 0.3 | 0.2 | | | 0.4 |
| $C_7^+$ | 5.5 | 52.6 | 60.7 | 18.4 | 9.4 | 54.0 | (2) | (3) | 6.3 |
| | 100.0 | 100.0 | 100.0 | 100.0 | 100.0 | 100.0 | 100.0 | 100.0 | 100.0 |
| $C_5^+$ Naphtha | | | | | | | | | |
| Wt. % of charge | 93.8 | 79.9 | 57.6 | 95.4 | 96.2 | 53.4 | Insufficient | | 94.2 |
| Gravity, ° API | 78.8 | 66.5 | 63.1 | 69.4 | 75.1 | 68.2 | | | 76.0 |
| Gravity, Specific | .6728 | .7146 | .7271 | 0.7045 | 0.6849 | .7086 | Sample | | 0.6819 |

Table I-continued

| Run Number | | 1 | 2 | 3 | 4 | 5 | 6 | 7 | 8 |
|---|---|---|---|---|---|---|---|---|---|
| O.N., R + O (MM) | 84 | 88.3 | 83.9 | 92.0 | 91.5 | 83.3 | | | |
| 400° F+ Fuel Oil | | | | | | | | | |
| Wt. % of Charge | — | 17.0 | 39.5 | — | — | 40.2 | | For | — |
| Gravity, ° API | — | 43.9 | 43.8 | — | — | 39.7 | | | — |
| Gravity, Specific | — | .8067 | .8072 | — | — | .8265 | | Distillation | — |
| Pour Point, ° F | — | <−70 | <−70 | — | — | <−70 | | | — |
| Aniline No., ° F | — | 144.9 | 167.5 | — | — | 162.0 | | | — |
| Diesel Index | — | 64 | 73 | — | — | 64 | | | — |

(1) Trace of aqueous layer in liquid product.
(2) Total $C_6^+$ yield = 74.9 weight percent.
(3) Total $C_6^+$ yield = 67.2 weight percent.

At reaction temperatures of 450° to 550° F, products are formed with boiling points above 400° F, very low pour points (< −70° F) and high diesel indices (65–70) (See data for run numbers 1, 2, and 5 in Table I). The properties of this fraction are very similar to those obtained on the 400°+ product when charging the whole $C_5^-$ 400° F synthol naphtha to dense phase processing.

EXAMPLES 2 & 3

A "kinetic model" was used to simulate reforming of the $C_7^+$ pretreated naptha and of the pretreated total $C_5^+$ naptha to higher octane products. The composition of the $C_5^+$ *charge is shown in Table II.*

Catalyst used in the model was Englehard's bimetallic Pt/Re/Alumina (E-601). Reformer operating conditions were 215 psia average reactor pressure (4 reactors), 1.5 LHSV, and 6 moles/mole total recycle ratio. Results of this treatment are summarized in Table III.

Figure 3:
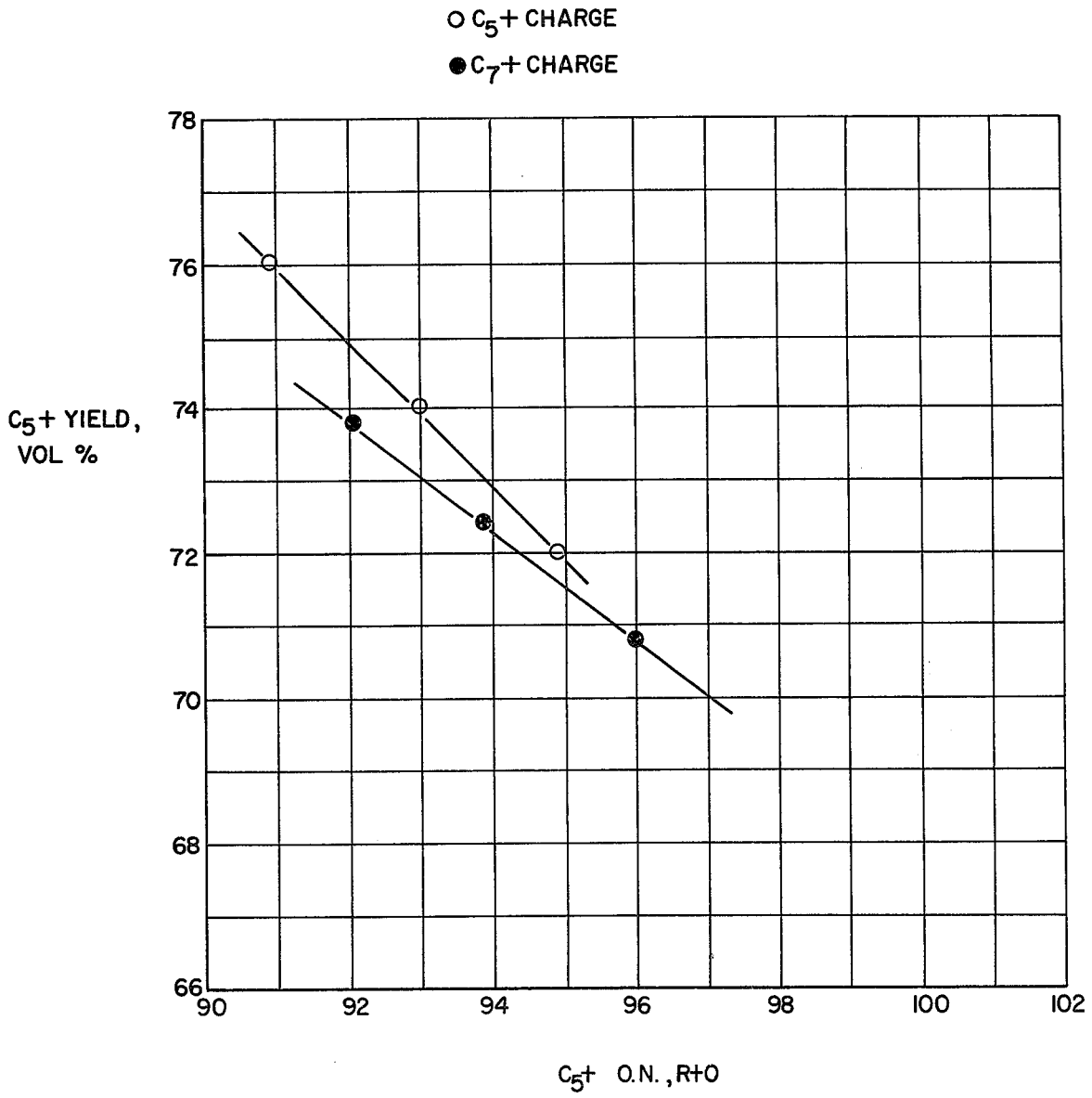
FIG. 3 is a yield-octane plot for low pressure reforming of pretreated $C_5^+$ and $C_7^+$ liquid products from a Fischer-Tropsch synthesis.

Yield-octane plots for both the $C_5^+$ and $C_7^+$ charges are in FIG. 3. At up to 96 R + O the $C_5^+$ charge gives higher yield than the $C_7^+$ *charge; above 96 R + O the* $C_7^+$ gives higher yield.

EXAMPLE 4

Table IV lists the combined yields at 93 R + O pool octane. The $C_5^+$ yield from reforming the total $C_5^+$ charge to 93 R + O is 74 volume percent. Combining unprocessed $C_5 + C_6$ fraction (84 R + O) with the reformate from $C_7^+$ charge at 97 R + O gives 77 volume percent 93 pool octane $C_5^+$ gasoline - a 3 volume percent yield gain over that obtained from reforming the $C_5^+$ charge to 93 (R + O) octane. An additional 1 volume percent increase is obtained by combining the dense phase processed $C_5 + C_6$ fraction (92 R + O) with reformate from $C_7^+$ charge at 94 R + O according to the process of this invention. Furthermore, the yield advantage for the combination process will increase with higher pool octanes.

Table II

| | | $C_5^+$ Charge Composition, Wt. % | | | |
|---|---|---|---|---|---|
| | | Raw Naphtha[a] (Charge to Pretreat) | | After Preheat[b] (Charge to Reformer) | |
| $C_5$'s, | Total | 7.0 | | 7.1 | |
| | i-$C_5$ | | 0.2 | | 1.1 |
| | n-$C_5$ | | 0.8 | | 6.0 |
| | $C_5$= | | 6.0 | | — |
| $C_6$'s, | Total | 15.4 | | 15.6 | |
| | i-$C_6$ | | 0.5 | | 2.4 |
| | n-$C_6$ | | 1.6 | | 12.8 |
| | $C_6$= | | 12.9 | | — |
| | MCP | | 0.3 | | 0.3 |
| | Benzene | | 0.1 | | 0.1 |
| $C_7$'s, | Total | 23.1 | | 23.4 | |
| | i-$C_7$ | | 1.2 | | 3.9 |
| | n-$C_7$ | | 1.7 | | 16.5 |
| | $C_7$= | | 17.2 | | — |
| | Cyclo $C_5$'s | | 1.2 | | 1.2 |
| | Toluene | | 1.8 | | 1.8 |
| $C_8$'s, | Total | 18.5 | | 18.8 | |
| | i-$C_8$ | | 2.4 | | 4.0 |
| | n-$C_8$ | | 1.4 | | 10.3 |
| | $C_8$= | | 10.2 | | — |
| | Cyclo $C_5$'s | | 2.2 | | 2.2 |
| | Aromatics | | 2.3 | | 2.3 |
| $C_9$'s, | Total | 14.2 | | 14.4 | |
| | i-$C_9$ | | 4.3 | | 5.4 |
| | n-$C_9$ | | 1.0 | | 6.9 |
| | $C_9$= | | 6.8 | | — |
| | Cyclo $C_5$'s | | 0.8 | | 0.8 |
| | Aromatics | | 1.3 | | 1.3 |
| $C_{10}$'s, | Total | 10.9 | | 11.0 | |
| | Paraffin | | — | | 8.8 |
| | Olefin | | — | | — |
| | Naphthene | | — | | 0.7 |
| | Aromatic | | — | | 1.5 |
| $C_{11}$'s, | Total | 9.4 | | 9.5 | |
| | Paraffin | | — | | 7.4 |
| | Olefin | | — | | — |
| | Napthene | | — | | 0.6 |
| | Aromatic | | — | | 1.5 |
| Unknowns | | 1.5 | | — | |
| | 100.0 | | 100.0 | | |

[a] Specific gravity of raw naptha 0.7363.
[b] Severity of treat sufficient to staturate olefins only (85% straight chain, based on $C_5$= composition).

Table III

| | Reforming Yields and Octanes | | | | | |
|---|---|---|---|---|---|---|
| | Example 2 $C_5^+$ Pretreated Charge | | | Example 3 $C_7^+$ Pretreated Charge | | |
| $C_5^+$ Octane No., R+O | 91.0 | 93.0 | 94.9 | 92.0 | 93.9 | 96.0 |
| $C_5^+$ Yield, Vol. % | 76.0 | 74.0 | 72.0 | 73.8 | 72.4 | 70.8 |
| Inlet Temp., ° F | 908 | 920 | 932 | 892 | 899 | 908 |
| Yields, Wt. % | | | | | | |
| $H_2$ | 1.3 | 1.4 | 1.6 | 1.4 | 1.5 | 1.6 |
| $C_1$ | 1.1 | 1.2 | 1.3 | 1.1 | 1.2 | 1.3 |
| $C_2$ | 2.6 | 2.8 | 3.1 | 2.8 | 3.0 | 3.2 |
| $C_3$ | 6.8 | 7.3 | 7.8 | 7.4 | 7.7 | 8.1 |
| $C_4$ | 9.0 | 9.6 | 10.2 | 9.9 | 10.2 | 10.8 |
| $C_5^+$ | 79.1 | 77.6 | 76.1 | 77.4 | 76.4 | 75.2 |

Table IV

| | Combined Yields at 93 Pool Octane (R+O) | | |
|---|---|---|---|
| | | Reforming $C_7^+$ | |
| | Reforming $C_5^+$ | Blend with Unprocessed $C_5 + C_6$[a] | Blend with Dense Phase Processed $C_5 + C_6$[b] |
| $C_5^+$ Yield, Vol. % | 74.0 | 77.2 | 78.1 |
| $C_5^+$ O.N., R+O | 93.0 | 93.0 | 93.3 |
| Yields, Wt. % | | | |
| $H_2$ | 1.4 | 1.3 | 1.2 |

Table IV-continued

| | Combined Yields at 93 Pool Octane (R+O) | | |
|---|---|---|---|
| | | Reforming $C_7^+$ | |
| | Reforming $C_5^+$ | Blend with Unprocessed $C_5 + C_6$[a] | Blend with Dense Phase Processed $C_5 + C_6$[b] |
| $C_1$ | 1.2 | 1.1 | 0.9 |
| $C_2$ | 2.8 | 2.6 | 2.3 |
| $C_3$ | 7.3 | 6.4 | 6.0 |
| $C_4$ | 9,6 | 8.6 | 7.9 |
| $C_5^+$ | 77.6 | 80.0 | 81.7 |
| | 100.0 | 100.0 | 100.0 |

[a] $C_7^+$ reformed to 97 R+O, raw $C_5 + C_6$ 84 R+O, linear blending.
[b] $C_7^+$ reformed to 94 R+O, dense phase processed $C_5 + C_6$ 92 R+O, linear blending.

What is claimed is:

1. A method for upgrading the $C_5$+ liquid product of a Fischer-Tropsch synthesis having an end-point from about 340° to 400° F which comprises:
   (a) fractionating said liquid product to separate a $C_5 + C_6$ fraction and a $C_7$+ fraction;
   (b) reforming the $C_7$+ fraction to produce a $C_5$+ reformate;
   (c) containing the $C_5 + C_6$ fraction in the absence of added hydrogen with a crystalline aluminosilicate characterized by a pore dimension greater than about 5 Angstroms, a silica to alumina ratio of at least 12, a constraint index within the range of 1 to 12 at dense phase process conditions of a temperature of about 325° to 500° F, a pressure of about 200 to 1000 psig, and a LHSV of about 0.1 to 5.0; and
   (d) recovering a $C_5$ gasoline product boiling up to about 400° F having an enhanced octane value from the dense phase processed $C_5 + C_6$ fraction; and
   (e) blending said $C_5$+ reformate with said $C_5$ gasoline product.

2. The process of claim 1 wherein the $C_5 + C_6$ fraction is contacted with the crystalline aluminosilicate at a temperature of about 400° F, a pressure of about 600–700 psig, and a LHSV of about 0.1 to 2.0.

3. A method for upgrading the $C_5$+ liquid product of a Fischer-Tropsch synthesis having an end-point from about 340° to 400° F which comprises:
   (a) fractionating the liquid product to separate a $C_5 + C_6$ fraction and a $C_7$ + fraction;
   (b) pretreating the $C_7$+ fraction by mild hydrogenation over a Co/Mo/Alumina catalyst;
   (c) catalytically reforming the $C_7$+ fraction to produce a $C_5$+ reformate;
   (d) contacting the $C_5 + C_6$ fraction in the absence of added hydrogen with a crystalline aluminosilicate selected from the group consisting of ZSM-5, ZSM-11, ZSM-12, ZSM-21, ZSM-35, and ZSM-38 at dense phase process conditions of a temperature of about 325° to 500° F, a pressure of 600 to 700 psig, and a LHSV of about 0.1 to 5.0; and
   (e) recovering a $C_5$ gasoline product boiling up to about 400° F having an enhanced octane value from the dense phase processed $C_5 + C_6$ fraction; and
   (f) blending said $C_5$+ reformate with said $C_5$ gasoline product.

4. The process of claim 3 wherein the $C_5$+ gasoline product recovered from the dense phase processed $C_5 + C_6$ fraction is hydrotreated prior to blending with the $C_5$+ reformate to produce a deoxygenated, gasoline boiling product of enhanced octane value.

5. The process of claim 3 wherein the crystalline aluminosilicate zeolite has been base exchanged with hydrogen ions or ammonium ions.

6. The process of claim 3 wherein the zeolite is ZSM-5.

7. The process of claim 5 wherein the zeolite is ZSM-5 which is composited with an inorganic oxide binder.

8. The process of claim 7 wherein the binder is alumina.

9. The process of claim 1 wherein a $C_5$ gasoline product boiling up to about 400° F having an enhanced octane value and a 400° F+ fuel oil product are recovered from the dense phase processed $C_5 + C_6$ fraction.

10. The process of claim 3 wherein at $C_5$ gasoline product boiling up to about 400° F having an enhanced octane value and a 400° F+ fuel oil product are recovered from the dense phase processed $C_5 + C_6$ fraction.

* * * * *

UNITED STATES PATENT AND TRADEMARK OFFICE

CERTIFICATE OF CORRECTION

PATENT NO. : 4,111,792

DATED : September 5, 1978

INVENTOR(S) : Philip D. Caesar et al

It is certified that error appears in the above-identified patent and that said Letters Patent are hereby corrected as shown below:

| | | |
|---|---|---|
| Figure on top page, Sheets 2 and 3 of Drawings | | "NAPTHA" should be "NAPHTHA" |
| Col. 2 | line 37 | "$C_5$+" should be "$C_5$" |
| Col. 2 | line 58 | "its" should be "is" |
| Col. 4 | line 64 | "porton" should be "portion" |
| Col. 5 | line 20 | "caly" should be "clay" |
| Col. 8 | line 2 | "chromotography" should be "chromatography" |
| Col. 8 | line 43 | "as an" should be "is an" |
| Col. 8 | line 68 | "4,016,265" should be "4,016,245" |
| Col. 9 | line 34 | "succh" should be "such" |
| Col. 11 | line 10 | "p." should be "P." |
| Col. 11-12 | line 23 (Table I) | "0.8" should be "0.3" |
| Col. 11-12 | Table I | Columns 6 and 7 should be underscored |
| Col. 12 | line 12 | "platted" should be "plotted" |
| Col. 13 | line 26 | "Englehard's" should be "Engelhard's" |

UNITED STATES PATENT AND TRADEMARK OFFICE

CERTIFICATE OF CORRECTION

PATENT NO. : 4,111,792

DATED : September 5, 1978

INVENTOR(S) : Philip D. Caesar et al

It is certified that error appears in the above-identified patent and that said Letters Patent are hereby corrected as shown below:

| | | |
|---|---|---|
| Col. 13 | line 29 | "6 moles" should be "7 moles" |
| Col. 13 | line 3 (Table II) | "After Preheat" should be "After Pretreat" |
| Col. 14 | line 3 (Table II) | "After Preheat" should be "After Pretreat" |
| Col. 15 | line 24 | "containing" should be "contacting" |
| Col. 16 | line 46 | "at" should be "a" |

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*